United States Patent [19]

Schnell

[11] 4,036,310

[45] July 19, 1977

[54] LINING FOR A PILE DRIVING HEAD AND METHOD AND TOOL FOR THE REMOVAL OF SAID LINING

[75] Inventor: Hans Günther Schnell, Hamburg, Germany

[73] Assignee: Van Kooten B.V., Naarden, Netherlands

[21] Appl. No.: 587,152

[22] Filed: June 16, 1975

[30] Foreign Application Priority Data

June 26, 1974 Netherlands ..... 7408633

[51] Int. Cl.[2] ..... E02D 7/02

[52] U.S. Cl. ..... 173/131; 52/125

[58] Field of Search ..... 173/130, 131; 61/53.5, 61/54; 52/125; 145/29 A, 29 B, 29 C, 29 D, 25

[56] References Cited

U.S. PATENT DOCUMENTS

| | | | |
|---|---|---|---|
| 1,023,615 | 4/1912 | Bohland | 173/130 |
| 1,943,420 | 6/1934 | Budd | 61/53.5 UX |
| 1,996,401 | 4/1935 | Bowen | 173/131 |
| 2,527,063 | 10/1950 | Heuer | 52/125 X |
| 2,772,560 | 12/1956 | Nepture | 52/125 X |
| 2,963,100 | 12/1960 | Smith | 173/131 X |
| 3,534,668 | 10/1970 | Scheincha | 52/125 X |
| 3,618,678 | 11/1971 | Smith | 173/131 |
| 3,800,888 | 4/1974 | Warrington | 173/131 |

*Primary Examiner*—Ernest R. Purser
*Assistant Examiner*—William F. Pate, III
*Attorney, Agent, or Firm*—Lewis H. Eslinger

[57] ABSTRACT

The removal of a lining, for example of wood, from a pile driving head is a very difficult and time-consuming operation. In order to remove the lining easily from the pile driving head, at least one armature is embedded in the lining to be used in the pile driving head, said armature being provided with fastening means, and a tool is connected with the armature by means of said fastening means for removing the lining. When the lining is stroke down during the pile driving operation, the armature with at least part of the lining is drawn from the pile driving head by means of said energized tool supporting on the driving head and/or a further part of the lining.

11 Claims, 9 Drawing Figures

FIG.1
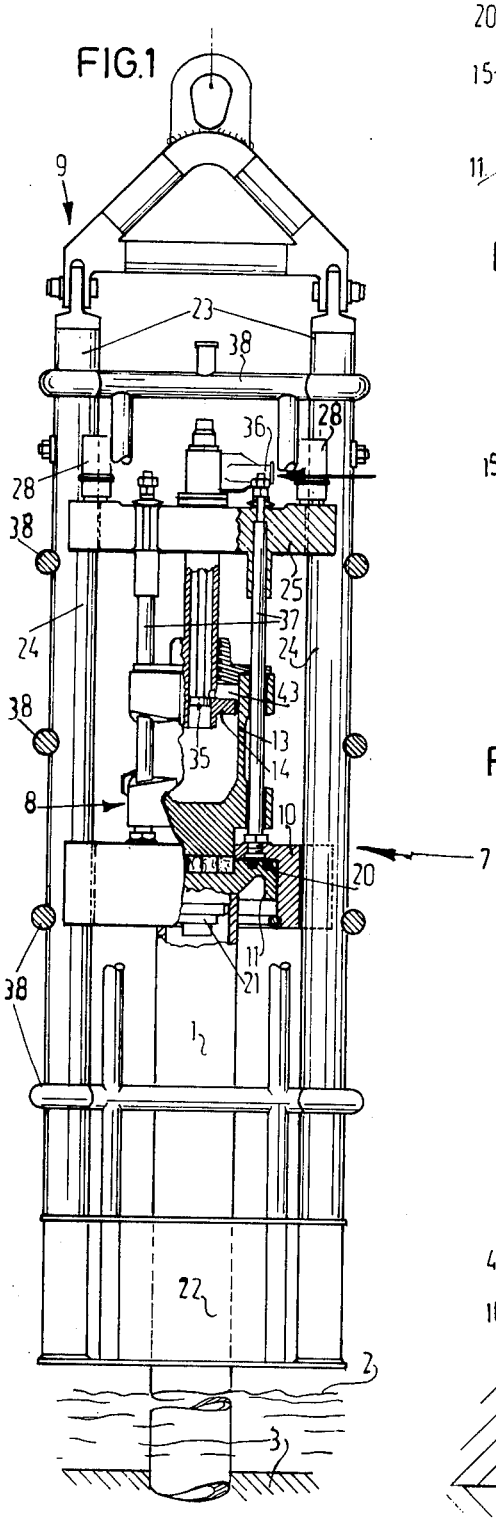
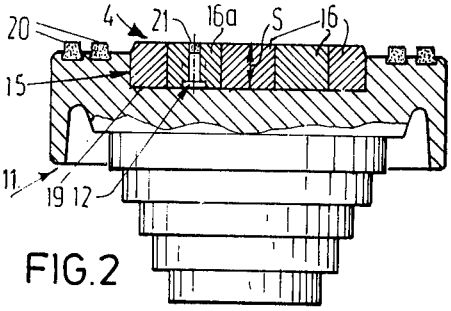
FIG.2
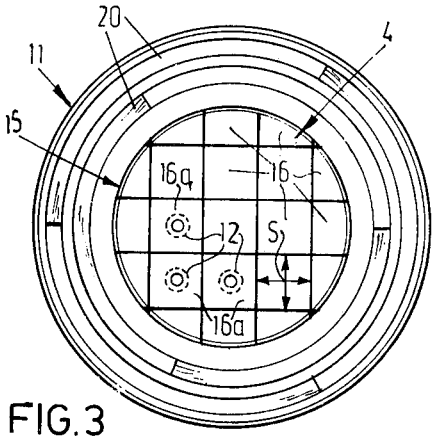
FIG.3
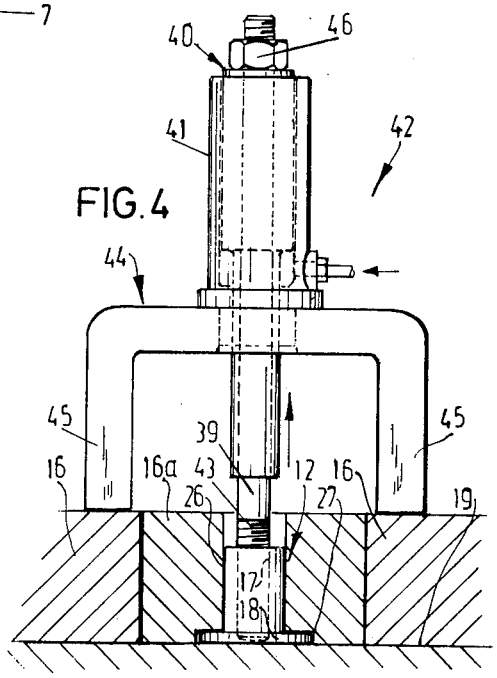
FIG.4

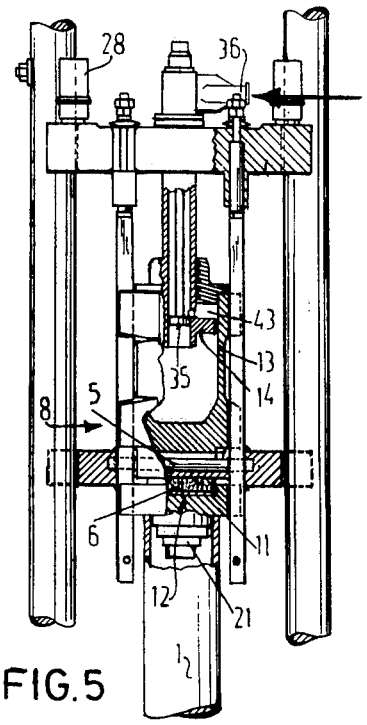
FIG.5
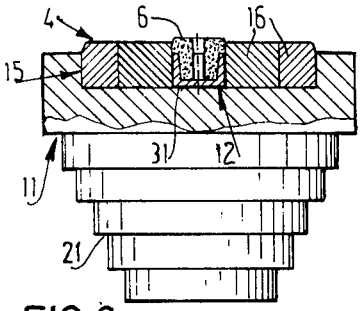
FIG.6
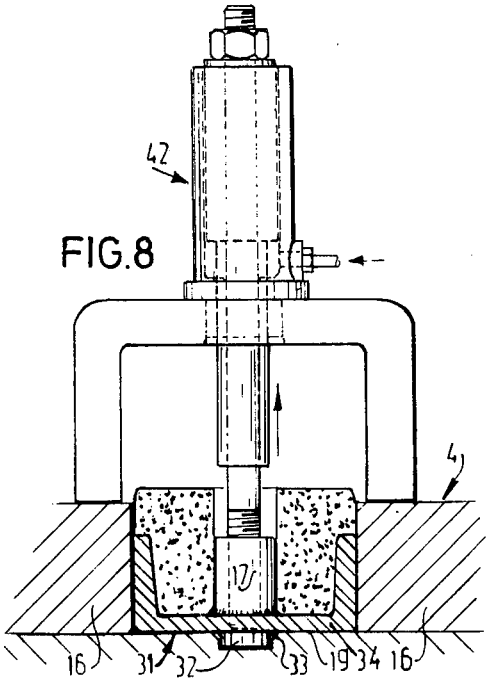
FIG.8
FIG.7
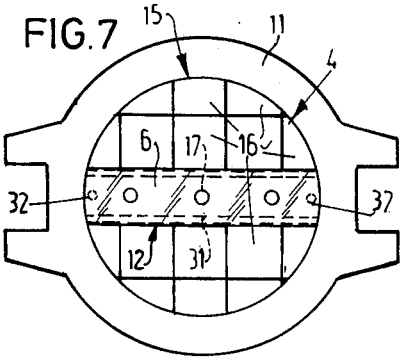
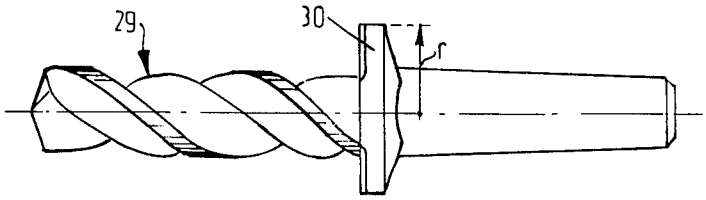
FIG.9

LINING FOR A PILE DRIVING HEAD AND METHOD AND TOOL FOR THE REMOVAL OF SAID LINING

The invention relates to a lining of a pile driving head and a method and tools for removing said lining.

The known lining consists of wood, which constantly rammed more tightly into the driving head in operation until its absorptive effect is completely lost. Then the compacted lining has to be replaced by a new one. The removal of this lining is performed by means of drills, chisels and the like, which is a time-consuming operation particularly in the base of large driving heads for driving long piles into subaqueous ground, in which case the hammers used have a very large weight, so that the work of the whole group of operators with the expensive pile driving rig is interrupted.

The invention has for its object to reduce or even to avoid completely the stagnation of the driving operations due to the removal of lining of the driving head. According to the invention an armature provided with fastening means is embedded in the lining and in order to remove the lining a tool is connected through the fastening means with the armature, which is then withdrawn with at least part of the lining from the driving head by means of the energized tool bearing on the driving head and/or on a further part of the lining. When carrying out this method the lining can be exchanged during the period of transfer of the pile driving device from one driven pile to the next pile to be driven.

The lining provided by the invention is characterized in that at least one armature with fastening means is embedded therein. When the armature extends diametrically in the driving head, the further parts of the lining can be readily removed after the central part of the lining fastened to the armature.

The fastening means may advantageously be formed by one or more screwthreaded sleeves. A very simple armature comprises a screwthreaded sleeve to which a foot plate is secured. In order to ensure easy accessibility to the screwthreaded sleeve a filling of a synthetic substance or the like is preferably provided above the armature. It is preferred to arrange a cushion of elastic material above the armature for elastically absorbing the impacts of a hammer.

The invention furthermore provides a tool for removing a lining which is characterized in accordance with the invention by supports engaging the driving head, at least one draw head engaging the fastening means and energizing means for exerting a tensile force on the draw head.

The aforesaid and further features of the invention will be described more fully hereinafter with reference to a drawing. In the drawing:

FIG. 1 is side elevation partly broken away of a pile driving device having a driving head shown in FIG. 2 in an enlarged sectional view provided with a lining in accordance with the invention, FIG. 3 is a plan view of the driving head of FIG. 2, FIG. 4 shows on an enlarged scale a detail of the driving head shown in FIG. 2 with tools for removing the lining in accordance with the invention, FIG. 5 is a side elevation partly broken away of a detail of a further pile driving device having a driving head shown in FIG. 6 in an enlarged sectional view, provided with a lining in accordance with the invention, FIG. 7 is a plan view of the driving head shown in FIG. 6, FIG. 8 shows on an enlarged scale a detail of a driving head as shown in FIG. 6 with tools for removing a lining in accordance with the invention, and FIG. 9 is a side elevation of a drill for preparing a lining element of a lining in accordance with the invention.

In order to drive piles 1 into the soil 3 located below the water level 2 a pile driving device 7 is arranged on the pile 1 by means of a floating derrick (not shown).

The pile driving device 7 comprises a hammer 8, a guide frame 9 for guiding the hammer 8 and and a driving head guide 10, bearing on the driving head 11. The hammer 8 strikes a lining 4 arranged in an annular chamber 15 of the driving head 11 and consisting of end-grain wood lining elements 16 in the form of square blocks of dimensions *s* of, for example, 25cms. As shown in FIGS. 1 to 4 an armature 12 is embedded in only three adjacent lining elements **16*a* forming a corner, said armature consisting mainly of a screwthreaded sleeve 17 and a footplate 18 welded thereto and bearing on the bottom 19 of the annular chamber 15. Each armature 12 is accommodated in a bore 26 and an annular groove 27 obtained in a single operation in a lining element 16*a* by means of a drill 29 (see FIG. 9) having cutters 30** projecting over a radius *r* of 15 cms.

Referring to FIGS. 5 to 8 the armature 12 comprises an inverted U-profile 31 bearing on the bottom 19 of the annular chamber 15 and centered by means of two pins 32 in corresponding recesses 33 of the bottom 19 and having three screwthreaded sleeves 17, welded to the web 34 of the U-profile 31. Above the U-profile 31 and around the screwthreaded sleeves 17 a rubber cushion 6 is arranged.

The hammer 8 may be a known Diesel hammer, but in FIGS. 1 and 5 it is formed by a known steam hammer comprising a heavy cylinder 13, a piston 14 rigidly secured to a guide member 25 and a steam inlet 36 controlled by a steam slide 35. The driving head guide 10 is connected by four setting rods 37 with the guide member 25. The guide member 25 is adapted to slide along upright guide stays 23, which together with a foot-support 22 and brackets 38 constitute the guide frame 9. The guide frame 9 bears, as shown in FIG. 1, through springs 28, thee guide member 25, four setting rods 37, the driving head guide 10 and the rubber rings 20 held in the driving head 11 and through the driving head 11 on the pile 1, whereas the hammer 8 in operation strikes the lining 4. Referring to FIG. 5 the guide frame 9 bears through springs 28, the guide member 25, two setting rods 37, a bridge piece 5 welded to the setting rods 37, a rubber cushion 6, the armature 12 and through the driving head 11 on the pile 1, whereas in operation the hammer 8 strikes the lining elements 16, arranged in the annular 15 of the driving head 11 on either side of the armature 12.

If the lining 4 is to be replaced in the driving head 11 of FIGS. 1 to 4 first a filling of synthetic resin or the like 21 located above each armature 12 is readily removed by drilling or in another suitable manner, after which a draw head 43 of a screwthreaded rod 39 of the tool 42 is screwed into the tapped hole of the screwthreaded sleeve 17, forming the fastening means, said sleeve 17 extending through the hollow piston 40 of the hydraulic cylinder 41 of the tool 42, forming the energizing means. The cylinder 41 engages a bridge piece 44 by supports 45 engaging the driving head 11 and/or adjacent lining elements 16. The top end of the screwthreaded rod 39 engages the piston 40 by means of a nut 46. By supplying fluid to the cylinder 41, for example, by means of a manual pump (not shown) the tool 42 is energized so that a tensile force of, for example, 50,000 kgs. is exerted on the armature 12, which together with the associated lining element **16*a* is drawn out of the annular chamber 15. In the same way each lining element 16*a* is removed, after which the further lining elements 16 can be readily loosened by inserting a chisel (not shown) between the lining elements 16 and the bottom 19.**

The armature 12 of the lining 4 of FIGS. 5 to 8 is drawn out together with the cushion 6 by exerting tensile force alternately on one of the three screwthreaded sleeves 17 by means of the tool 42 until the armature 12 as a whole is drawn away. Then the lining elements 16 can be lifted by means of a chisel (not shown) inserted beneath them.

Finally a new lining 4 is disposed in the annular chamber 15 of the driving head 11, in which the armatures 12 described above with reference to FIGS. 1 to 4 or FIGS. 5 to 8 are embedded.

If desired, three identical tools 42 are employed side by side one on each of the screwthreaded sleeves 17 so that the armature 12 can be drawn out by a total force of 150,000 kgs.

What I claim is:

1. For use in a pile driver including a driving head having an upwardly opening chamber formed therein, a lining in said chamber including, a plurality of coplanar lining elements in side by side relation in said chamber of the driving head, an armature positioned in said chamber adjacent at least one of said lining elements and being removable from said chamber, said armature having interengaging means extending axially therealong in the direction of said lining elements for interengagement with a removing tool adapted to remove said armature thereby to leave a space in the chamber adjacent said at least one lining element to accommodate ready removal of said lining elements.

2. A lining as in claim 1, wherein the interengaging means between the armature and the tool comprises interengaging threaded connections.

3. A lining of claim 1, wherein the interengaging means comprises a plurality of screw threaded sleeves and the tool has screw threaded ends threaded in said sleeves.

4. A lining as defined in claim 1, wherein the armature is imbedded in at least one of said lining elements and has a flange on the lower end thereof forming a foot plate bearing on the bottom of the driving head and the armature and lining element in which it is imbedded are removed by axial force of the tool in a lining element removal direction extending axially of said head.

5. A lining of claim 1, wherein a plurality of armatures are provided, each being imbedded in a separate lining element, and wherein each armature comprises a screw threaded sleeve having a footplate on the bottom thereof bearing against the bottom of an associated lining element.

6. A lining of claim 1, wherein the armature extends axially along the driving head and at least two setting pins are provided to center the armature relative to the driving head.

7. A lining element as defined in claim 1, wherein separate armatures having interengageable fastening means are imbedded in at least two of said lining elements and the tool has threaded interengagement with said armatures for removing said at least two lining elements.

8. A lining of claim 1, including a separate armature for said at least two lining elements and a separate tool for each armature and having interengagement therewith to remove said at least two of said lining elements and thereby accommodate ready removal of the remainder of said lining elements.

9. A lining element as defined in claim 1, wherein a cushion of elastic material is provided above the armature.

10. A lining of claim 9, wherein the cushion of elastic material is a filling of a synthetic resin.

11. A lining of claim 2, wherein the armature is of a U-shaped profile in side elevation and the fastening means comprises a screw threaded sleeve welded to the web of the U-shaped profile of the armature.

* * * * *